United States Patent [19]

Pohto et al.

[11] 4,056,458

[45] Nov. 1, 1977

[54] MONOPOLAR MEMBRANE ELECTROLYTIC CELL

[75] Inventors: Gerald R. Pohto, Mentor; Michael J. Kubrin, Chardon; Robert C. Sutter, Painesville, all of Ohio

[73] Assignee: Diamond Shamrock Corporation, Cleveland, Ohio

[21] Appl. No.: 718,060

[22] Filed: Aug. 26, 1976

[51] Int. Cl.[2] ..... C25B 9/00; C25B 15/08; C25B 11/02

[52] U.S. Cl. ..... 204/263; 204/257; 204/289

[58] Field of Search ..... 204/252, 253, 254, 255, 204/256, 257, 258, 263, 289

[56] References Cited

U.S. PATENT DOCUMENTS

| | | | |
|---|---|---|---|
| 2,786,811 | 3/1957 | Swope | 204/258 X |
| 2,872,406 | 2/1959 | Buchanan | 204/257 X |
| 3,663,412 | 5/1972 | Kling et al. | 204/263 X |
| 3,673,076 | 6/1972 | Juckniess | 204/256 |

*Primary Examiner*—John H. Mack
*Assistant Examiner*—D. R. Valentine
*Attorney, Agent, or Firm*—Bruce M. Winchell

[57] ABSTRACT

Disclosed are electrode assemblies which can be used to build a monoplanar membrane electrolytic cell suitable for the production of chlorine, alkali metal hydroxides and hydrogen having at least one central electrode assembly sandwiched between two end electrode assemblies with membranes therebetween to form a closed cell. Several of these resulting electrolytic cells can be connected in series or parallel to form electrolyzers very suitable for the electrolysis of a solution of sodium chloride or potassium chloride.

29 Claims, 12 Drawing Figures

MONOPOLAR MEMBRANE ELECTROLYTIC CELL

BACKGROUND OF THE INVENTION

The present invention relates generally to the construction of a monopolar membrane electrolytic cell for the production of chlorine, alkali metal hydroxides and hydrogen, wherein each electrolytic cell unit has at least one central electrode assembly with at least two end electrode assemblies on either side thereof so as to form a closed system for efficient utilization of the materials for the central electrode assemblies. More particularly the present disclosure relates to an improved electrolytic cell structure having a central electrode assembly with an end electrode assembly contained on either side thereof to form a closed cell such that when several of the cells are linked in series or parallel to form an electrolytic cell bank, any given cell may be removed therefrom without interruption of production from other identical cell units. This employs the use of the planar electrode elements such that a planar membrane may be spaced between the elements to provide a membrane electrolytic cell especially suitable for the production of chlorine, caustic (sodium hydroxide) and hydrogen.

Chlorine and caustic are essential and large volume commodities which are basic chemicals required in all industrial societies. They are produced almost entirely electrolytically from aqueous solutions of alkali metal chlorides with a major portion of such production coming from diaphragm type electrolytic cells. In the diaphragm electrolytic cell process, brine (sodium chloride solution) is fed continuously to the anode compartment and flows through a diaphragm usually made of asbestos, backed by a cathode. To minimize back migration of the hydroxide ions, the flow rate is always maintained in excess of the conversion rate so that the resulting catholyte solution has unused alkali metal chloride present. The hydrogen ions are discharged from the solution at the cathode in the form of hydrogen gas. The catholyte solution, containing caustic soda (sodium hydroxide), unreacted sodium chloride and other impurities, must then be concentrated and purified to obtain a marketable sodium hydroxide commodity and sodium chloride which can be reused in the chlorine and caustic electrolytic cell for further production of sodium hydroxide.

With the advent of technological advances such as the dimensionally stable anode and various coating compositions therefor which permit ever narrowing gaps between the electrodes, the electrolytic cell has become more efficient in that the current efficiency is greatly enhanced by the use of these electrodes. Also, the hydraulically impermeable membrane has added a great deal to the use of electrolytic cells in terms of the selective migration of various ions across the membrane so as to exclude contaminents from the resultant product thereby eliminating some costly purification and concentration steps of processing.

The dimensionally stable anode is today being used by a large number of chlorine and caustic producers but the extensive commercial use of hydraulically impermeable membranes has yet to be realized. This is at least in part due to the fact that a good electrolytic cell structure for use of the planar membrane versus the three dimensional diaphragm has yet to be provided. The geometry of the diaphram electrolytic cells structure makes it undesirable to place a planar membrane between the electrodes, hence the filter press electrolytic cell structure has been proposed as an alternative electrolytic cell structure for the use of membrane in the production of chlorine, alkali metal hydroxides and hydrogen.

A bipolar filter press electrolytic cell is a cell consisting of several units in series as in a filter press in which each electrode except the two end electrodes act as an anode on one side and a cathode on the other, with the space between these bipolar electrodes being divided into an anode and a cathode compartment by the membrane. In a typical operation, an alkali metal halide is fed into the anode compartment where halogen gas is generated at the anode. Alkali metal ions are selectively transported through the membrane into the cathode compartment and combined with hydroxide ions at the cathode to form alkali metal hydroxides and liberate hydrogen. In this type of cell the resultant alkali metal hydroxide is significantly purer and more concentrated, thus minimizing an expensive salt recovery step of processing. Cells where the bipolar electrodes and diaphragms or membranes are sandwiched into a filter press type construction may be electrically connected in series, with the anode of one connected to the cathode of an adjoining cell through a common structure member of some sort. This arrangement is generally known as a bipolar configuration.

While the filter press electrolytic cell provides certain economies in operation with the use of a membrane there still remains the problem that if a given cell section within the cell goes bad, the entire cell structure must be broken down in order to remove the faulty component and the entire cell is out of production for the given period of time. Furthermore, hydrogen embrittlement poses a materials problem for the bipolar configuration. Therefore, it would be exceedingly advantageous to develop a membrane electrolytic cell unit which may be taken out of an electrolytic cell bank without having to discontinue production of the entire electrolytic cell bank.

SUMMARY OF THE INVENTION

It is therefore an object of the present invention to provide a monopolar membrane electrolytic cell which is self contained such that it may be removed from a bank of electrolytic cells without forcing the discontinuation of production from the entire bank of cells.

It is another object of the present invention to provide a monopolar membrane electrolytic cell which may be entirely sealed at the point of manufacture so that shipment and start-up of such units could be accomplished with less onsight preparation of the cells to form an electrolytic cell bank.

It is another object of the present invention to provide a monopolar membrane electrolytic cell unit which may be withdrawn from an electrolytic cell bank and sent to a central processing facility for maintenance and repair of each given cell without causing disruption of production from the entire electrolytic cell bank.

It is another object of the present invention to provide a central electrode assembly that may be sandwiched between two end electrode assemblies in any number to build electrolytic cells of various sizes.

These and other objects of the present invention, together with the advantages thereof over existing and prior art forms which will become apparent to those skilled in the art from the detailed disclosure of the present invention as set forth hereinbelow, are accomplished by the improvements herein shown, described and claimed.

It has been found that a monopolar membrane electrolytic cell can be assembled from; two end electrode pans of identical configuration having a peripheral flange; two electrode elements, one connected to the interior depression of each; at least one central frame having a peripheral flange on each side thereof to match the corresponding flanges of other identical frames or the end electrode pans; a bifurcated electrode element such that each part presents a substantially planar surface to other identical electrode elements or the corresponding end electrode elements; a membrane separating the electrode elements when the cell is assembled; current distributors to supply electrical energy of opposite polarity to consecutive electrode elements; and at least one access port in each central electrode from and each end electrode pan for adding materials or removing products.

It has also been found that an end electrode assembly for an electrolytic cell can comprise: a pan having a central depression and a peripheral flange; an electrode element connected to the central depression of said pan; at least two current distributors to supply electrical energy to said electrode element, electrically and mechanically attached to said electrode element and extending exterior of said pan; and at least one access port in said pan for adding or removing materials from the interior of said pan.

It has also been found that a central electrode assembly for an electrolytic cell can comprise: a frame having peripheral flanges on each side thereof; a bifurcated electrode element secured to the interior confines of said frame presenting a substantially planar surface to each side of said frame and nearly coplanar with the peripheral flanges; at least two current distributors between said bifurcated electrode element surfaces to supply electrical energy to said bifurcated electrode element, electrically and mechanically connected to said biifurcated electrode element and extending exterior of said frame; and at least one access port in said frame for adding or removing materials from the interior of said frame.

The preferred embodiments of the subject electrolytic cell are shown by way of example in the accompanying drawings without attempting to show all the various forms and modifications in which the invention might be embodied; the invention being measured by the appended claims and not by the details of this specification.

DESCRIPTION OF THE PREFERRED EMBODIMENTS

Figures 1, 1A:
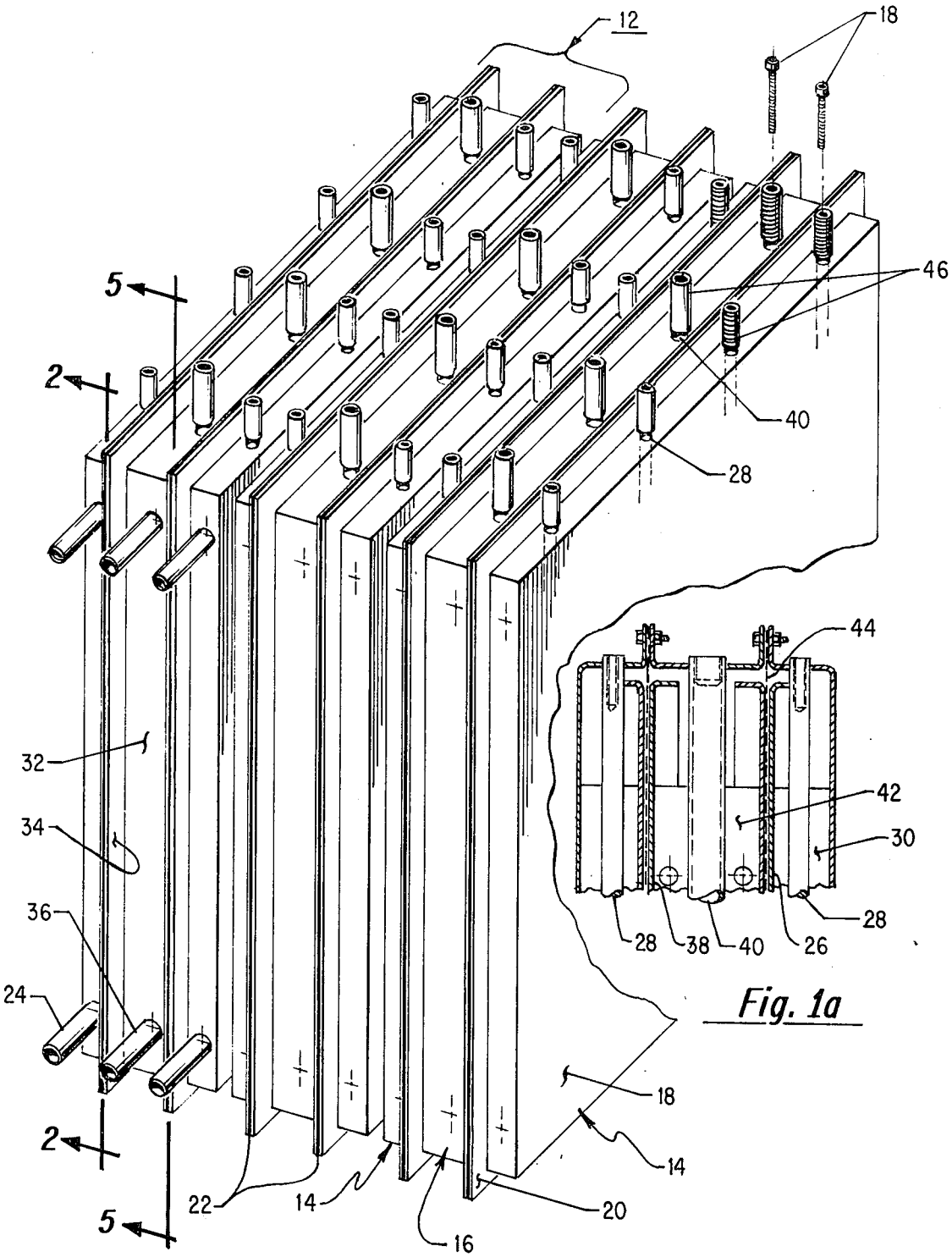
FIG. 1 is a front perspective view of a bank of three monopolar membrane electrolytic cells according to the concepts of the present invention.
FIG. 1*a* is a partial sectional view of one cell.

Referring to FIG. 1 of the drawings numeral 12 refers to a monopolar membrane electrolytic cell according to the concepts of the present invention. FIG. 1 shows three such electrolytic cells 12 as they would be commonly used in an electrolytic cell bank for the production of chlorine and caustic. These electrolytic cells 12 as shown in FIG. 1 would generally have some environmental supporting structure or foundation to maintain each of the electrolytic cells 2 in correct alignment so as to build a bank of electrolytic cells for production purposes. The details of this environmental structure have not been shown for ease of illustrating the concepts of the present invention.

Figure 11:
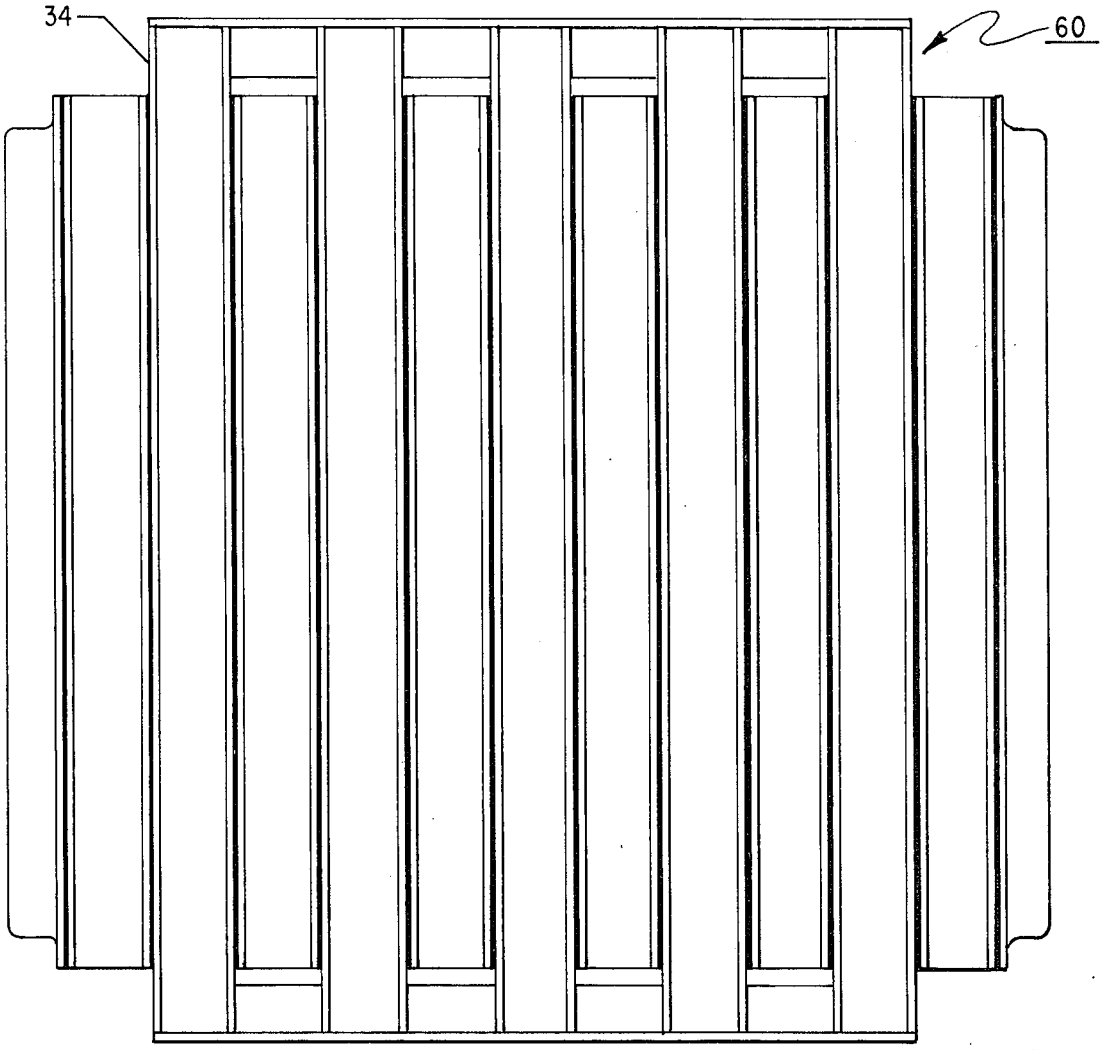
FIG. 11 is an elevation view of an alternate embodiment of a monopolar membrane electrolytic cell having more than one central electrode assembly arranged in filter press fashion.

As it can be observed from the partial sectional view of FIG. 1*a*, each electrolytic cell 12 has two end electrode assemblies 14 with at least one central electrode assembly 16 sandwiched therebetween. When these assemblies 14 and 16 are combined and sealed they produce a closed structure electrolytic cell 12 which may be combined into a bank of electrolytic cells. With this type of cell bank any one of three electrolytic cells 12 pictured in FIG. 1 may be removed while maintaining production from the remaining cells in the electrolytic cell bank. This provides a distinct economic advantage over cells where the production of the entire cell bank must be terminated in order to remove any given bad section for maintenance or repair. Also, it is contemplated that any number of electrolytic cells 12 can be combined into the cell bank to produce a given production requirement as desired. It is also contemplated that a monopolar filter press type electrolytic cell 60 could be assembled by having central electrode assemblies 16 of opposite polarity sandwiched together with end electrode assemblies 14 at each end of the electrolytic cell structure as best seen in FIG. 11.

Figure 4:
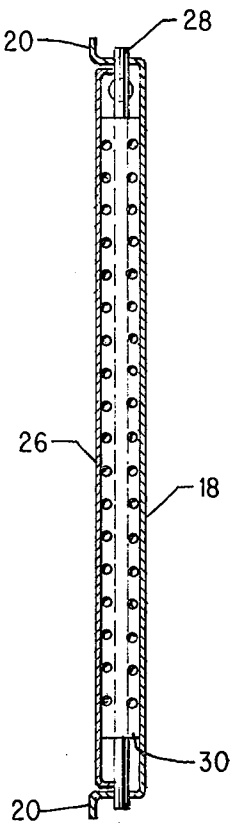
FIG. 4 is a sectional view of the end electrode assembly taken substantially along line 4—4 of FIG. 2.
Figure 2:
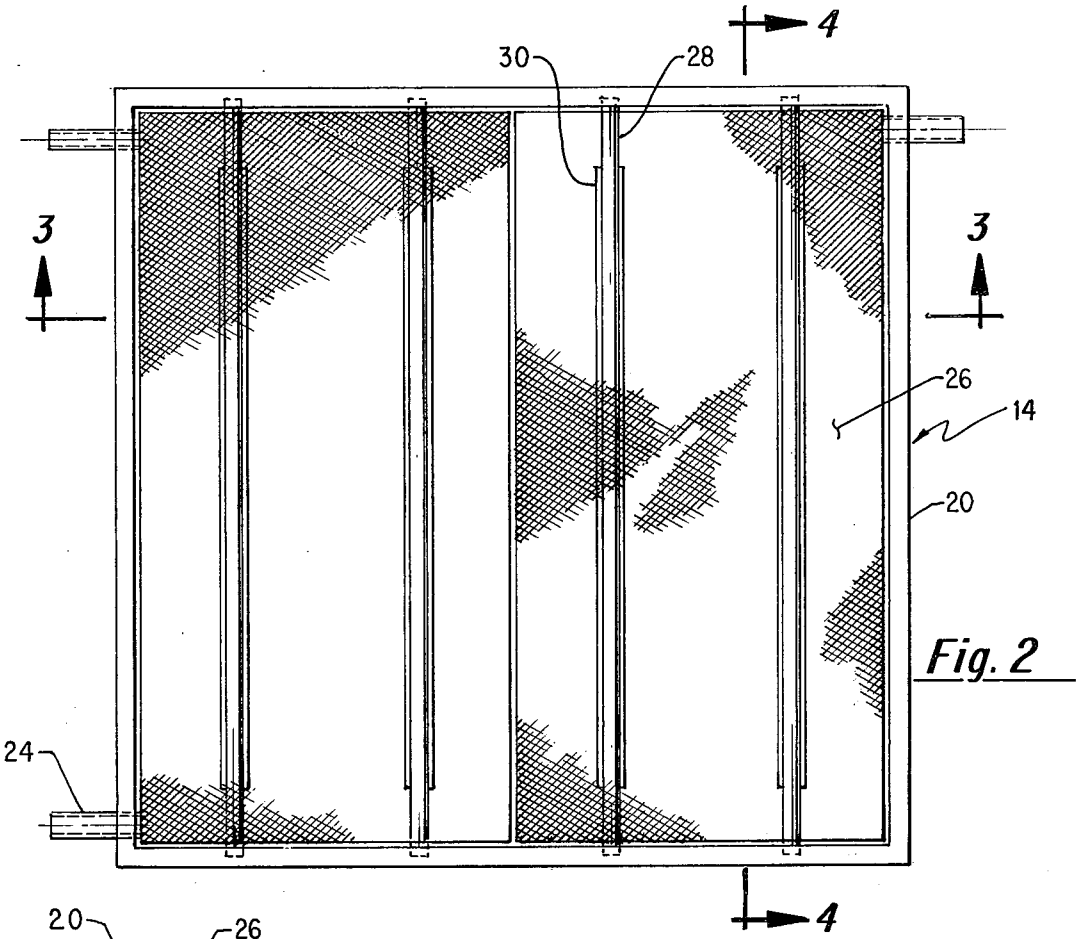
FIG. 2 is a side elevation of the end electrode assembly taken substantially along line 2—2 of FIG. 1.
Figure 3:
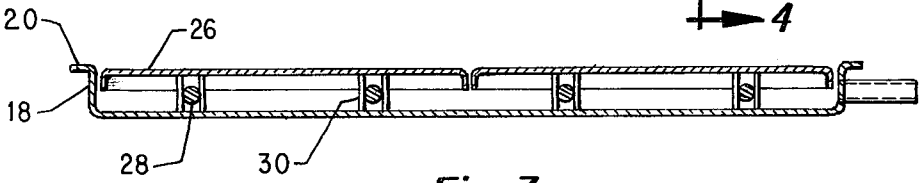
FIG. 3 is a sectional view of the end electrode assembly taken substantially along line 3—3 of FIG. 2.

A closer look at the end electrode assembly 14 can be seen in FIG. 2 which is a side elevation view of the end electrode assembly 14 taken substantially along line 2—2 of FIG. 1. FIG. 3 shows a bottom section view of the end electrode assembly 14 and FIG. 4 shows a frontal section view of the end electrode assembly 14 as detailed from FIG. 2. As can be seen in FIGS. 2, 3 and 4 the end electrode assembly 14 has an end electrode pan 18 which may be conventionally manufactured by stamping out a single sheet. The end electrode pan 18 also has a peripheral flange 20 by which the end electrode assembly 14 is attached and sealingly engaged with a cental electrode assembly 16. The peripheral flange 20 therefore must be relatively flat and smooth in nature so as to form an effective seal with the gasketing material which goes thereover. Gasketing 22 would be placed on top of the peripheral flange 20 before it is combined with a central electrode assembly 16 for connection thereto as can be seen in FIG. 1. Generally a piece of gasketing 22 will be used on each peripheral flange such that two pieces will be used in each given joint between any two assemblies 14 and 16. The end electrode pans 18 will generally have a thickness in the range of 1/32 to 3/8 inch (0.794 to 9.525 mm.). It is contemplated that if greater rigidity of the end electrode pans 18 is desired, that the ridges may be stamped into the central depression of each pan 18 or reinforcing members attached to the outside of the depressed area.

As can be seen in FIG. 2 there are several access ports 24 through the end electrode pan 18 to provide adequate circulation within the end electrode assembly 14 of the electrolytic cell 12. These access ports 24 in addition to providing circulation are used for input of raw materials and take off of any products as may be necessary for a given electrolytic cell 12. Contained within the depressed area of the end electrode pan 18 are end electrode elements 26 which are generally foraminous in nature such that circulation may be had therethrough and therearound. Generally the foraminous end electrode element 26 material is an expanded metal mesh having a flattened edge on one side and a rounded edge on the opposing side. It could just as conveniently be made of woven wire mesh, rod screen or perforated plates to accomplish a foraminous active surface.

As can be seen in FIGS. 3 and 4, the peripheral edge of each end electrode element 26 is turned down approximately 90° to insure that pointed edges of the end electrode elements 26 do not puncture a membrane material which would go thereover. The rounded edge side is placed toward the membrane and the flattened edge side of the expanded metal mesh to the interior of the end electrode pan 18 along with the turned down edges of the end electrode element 26.

The end electrode elements 26 are connected to the end electrode pan 18 by current distributors 28 and spacer bars 30 such that the end electrode element 26 presents a planar surface very nearly coplanar with the surface of the peripheral flange 20 of the end electrode pan 18. It will be noticed that the spacer bars 30 do not extend the entire length of the end electrode element 26 as best seen in FIG. 4. Also the spacer bars 30 have apertures therethrough periodically as seen in FIG. 4 such that circulation of electrolyte solution may be effectively accomplished within the end electrode assembly 14. The end electrode element 26 may be attached to spacer bars 30 by any convenient means, weldment being among the most suitable. The current distributors 28 each support two spacer bars 30 on either side thereof and extend to the exterior of the end electrode pan 18 as seen in FIG. 1 for electrical connection of the cell 12 to a power source not shown herein.

Whatever number of end electrode elements 26 may be used within the confines the end electrode pan 18, each is preferably supported by two end electrode current distributors 28 to insure good current distribution and to provide stability against rotational forces. This arrangement also facilitates the manufacturing process. Generally this will be two end electrode elements 26 but if the size of the pan is increased than more may be desirable.

The materials used for construction of the end electrode element 26 spacer bars 30, current distributors 28 and the end electrode pan 18 when they are to be used for the cathodic side of the electrolytic cell 12, may include any conventional electrically conductive material resistant to the catholyte such as: iron, mild steel, stainless steel, nickel, stainless steel clad copper or nickel clad copper. It has been found for instance that if all the components are made of steel, assembly and final operation of the cell is greatly facilitated thereby. Use of a single material for all these components facilitates conventional weldments so as to reduce the ultimate cost of assembly of the component parts. The use of the clad materials such as stainless steel or nickel over copper for the currend distributors 28 will provide some voltage savings because of the higher conductivity of the copper core. Also, the weldments necessary in the manufacture of the end electrode assembly 14 must be airtight such that upon placing the end electrode assembly 14 into a cell 11 it will form a closed system.

Figure 7:
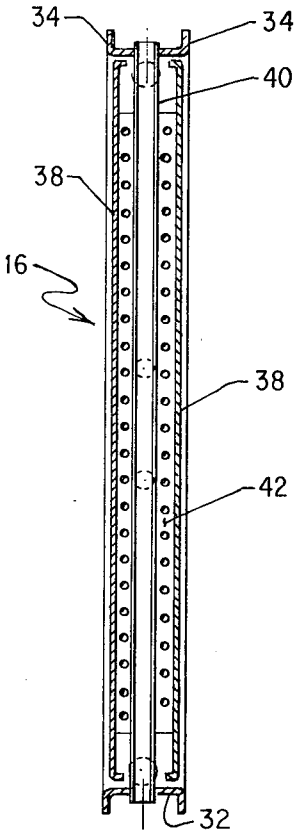
FIG. 7 is a sectional view of the central electrode assembly taken substantially along line 7—7 of FIG. 5.
Figure 5:
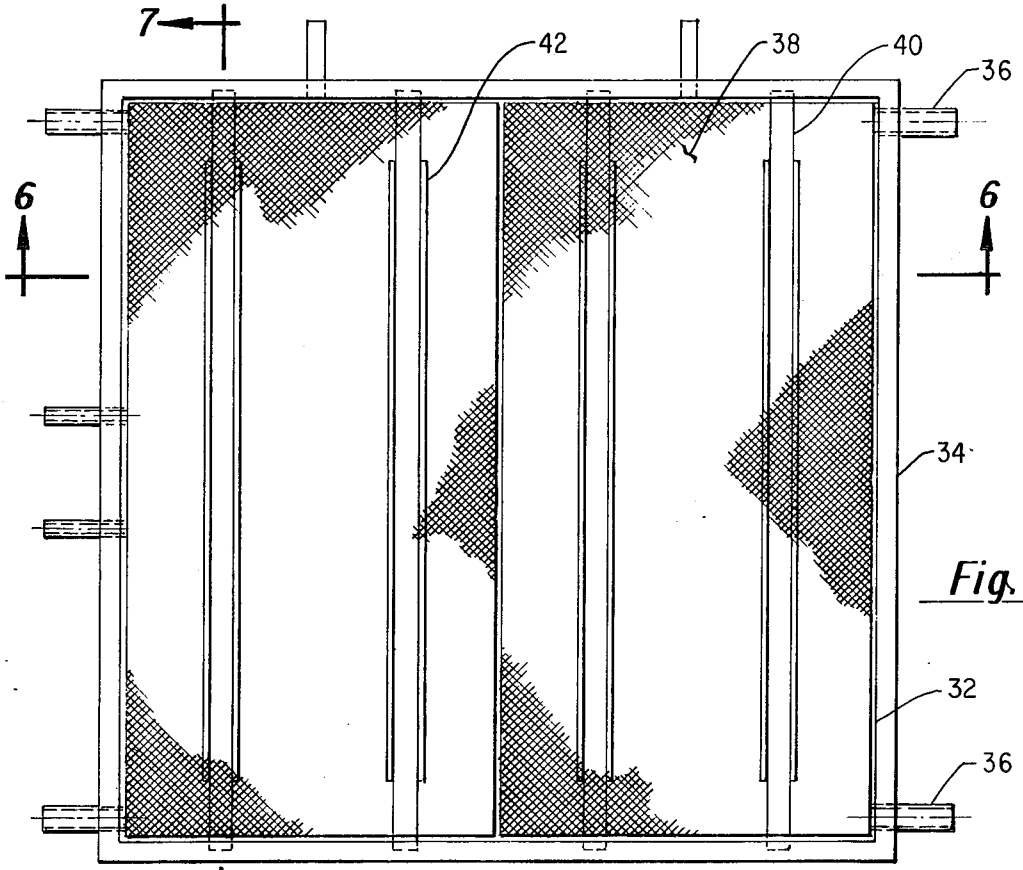
FIG. 5 is a side elevation view of the central electrode assembly taken substantially along line 5—5 of FIG. 1.
Figure 6:
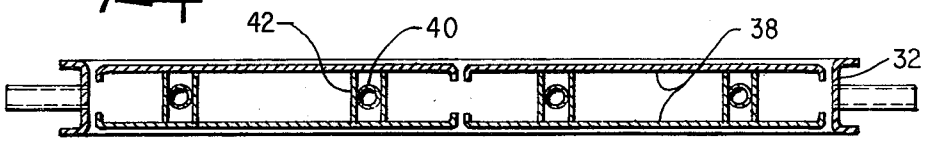
FIG. 6 is a sectional view of the central electrode assembly taken substantially along line 6—6 of FIG. 5.

FIG. 5 is an elevation view of the central electrode assembly 16 taken substantially along line 5—5 of FIG. 1 corresponding to the FIG. 2 view of the end electrode assembly 14. FIG. 6 is a bottom section view of the central electrode assembly 16 taken from FIG. 5 corresponding to the FIG. 3 bottom section view of the end electrode assembly 14. FIG. 7 is a frontal section view of the central electrode assembly taken from FIG. 5 corresponding to the FIG. 4 view of the end electrode assembly 14. As can be seen from FIGS. 5, 6 and 7 the differing feature between the end electrode assembly 14 and the central electrode assembly 16 is that the central electrode assembly 16 has a frame 32 such that electrode surfaces may be presented in two directions to permit the central electrode assembly 16 to be sandwiched in between other identical assemblies of opposite polarity or end electrode assemblies 14. This provides better utilization of expensive materials and reduces the weight of a resultant electrolytic cell 12 significantly. The frame 32 has peripheral flanges 34 on each side thereof so as to form a channel like member. These peripheral flanges 34 on frame 32 correspond identically to the peripheral flanges 20 on the end electrode pan 18 so that a sealing engagement may be had therebetween with the use of gasketing 22. Frame 32 also has access ports 36 such that electrolyte may be circulated throughout the cental electrode assembly 16, more material added to the central electrode assembly 16, and products taken off from the central electrode assembly 16.

A central electrode element 38 is similar in mechanical design to the end electrode element 26 in that it is generally formainous in nature and made of an expanded metal mesh having a turned down edge around the peripheral edge of the central electrode element 38. The central electrode element 38 is of a bifurcated design so as to present an active surface to each side of frame 32. Bifurcated as hereinafter used shall refer to two planar electrode elements in spaced parallel alignment. As in the case of the end electrode element 26 the central electrode element 38 is in two sections contained within the confines of the frame 32. Current distributors 40 run through the central portion of the central electrode frame 32 to distribute power to the entire surface of the central electrode element 38 in the same manner as the current distributors 28 distribute electrical energy to the end electrode element 26. These current distributors 40 extend through frame 32 for electrical connection to a power source not shown herein to complete an electrical circuit by which an electrolyzing current may be applied to the monopolar membrane electrolytic cell 12. Attached to these current distributors 40 by conventional weldment procedures are spacer bars 42 which maintain the cental electrode element 38 in nearly coplanar relations with the peripheral flanges 34. These spacer bars 42 like the spacer bars 30 of the end electrode assembly 14 do not extend the entire length of the current distributors 40 so as to enhance circulation of the electrolyte solution within the central electrode assembly 16. To further enhance circulation of the electrolyte solution within the central electrode assembly 16, spacer bars 42 have apertures therethrough. The spacer bars 42 support on either side thereof in bifurcated fashion a set of cental electrode elements 38 so as to provide central electrode elements 38 facing each of two end electrode assemblies 14 or other central electrode assemblies 16 of opposite polarity when assembled to form a filter press type monopolar membrane electrolytic cell 60.

The central electrode elements 38 to be used as anodes may be constructed of any conventional electrically conductive electrocatalytically active material resistant to the anolyte such as valve metal like titanium, tantalum or alloy thereof, bearing on the surface a noble metal, a noble metal oxide (either alone or in combination with a valve metal oxide) or other electrocatalytically active corrosion resistant materials. Anodes of this class are called dimensionally stable anodes that are well known and widely used in the industry. See for example, U.S. Pat. Nos.: 3,117,023; 3,632,498; 3,840,443 and 3,846,273. A preferred valve metal based on cost, availability, electrical and chemical properties at this time seems to be titanium. If titanium is used for anode elements, fabrication of the central electrode assembly 16 can be facilitated by using titanium materials for the frame 30 and the spacer bars 42. To reduce the use of titanium and the cost thereby, the current distributors 40 can be copper for excellent electrical conductivity having a titanium coating thereover. This then allows the fabrication of the central electrode assembly 16 by conventional weldments to provide an airtight system when asembled into the monopolar membrane electrolytic cell 12.

It is anticipated that each electrode assembly 14 or 16 be separated from each other electrode assembly 14 or 16 of opposite polarity by a membrane 44. The membrane 44 may be any substantially hydraulically impermeable cation-exchange membrane which is chemically resistant to the cell liquor, has low resistivity, resists forward migration of chloride ions and resists back migration of hydroxide ions. The type of material used for membrane 44 must be small cation permeable only so that sodium and potassium ions will migrate therethrough but virtually none of the larger cations such as the metal impurities of the cell liquor will pass therethrough. The use of these materials for membrane 44 will result in an alkali metal hydroxide of significantly higher purity and higher concentration.

One type of hydraulically impermeable cation-exchange membrane which can be used in the apparatus of the present invention is a thin film of fluorinated copolymer having pendant sulfonic acid groups. The fluorinated copolymer is derived from monomers of the formula $$CF_2 = CF\text{-}(R)_n\,SO_2F$$

in which the pendant—$SO_2F$ groups are converted to—$SO_3H$ groups, and monomers of the formula $$CF_2 = Cxx' \qquad (2)$$

wherein R represents the group $$-\overset{\overset{R}{|}}{C}F-CF_2-O\text{-}(CFY-CF_2O)\text{-}_m$$

in which the $R^1$ is fluorine or fluoroalkyl of 1 thru 10 carbon atoms; Y is fluorine or trifluoromethyl; *m* is 1, 2 or 3; *n* is 0 or 1; *x* is fluorine, chlorine or trifluoromethyl; and $x^1$ is *x* or $CF_3(CF_2)_a$ O—, wherein *a* is 0 or an integer from 1 to 5.

This results in copolymers used in the membrane for the cell having the repeating structural units.

$$-CF_2-\underset{\underset{SO_3H}{|}}{\underset{\underset{(R)_n}{|}}{CF}}- \qquad (3)$$

and $$-CF_2-Cxx^1- \qquad (4)$$

In the copolymer there should be sufficient repeating units according to formula (3) above, to provide an —$SO_3H$ equivalent weight of about 800 to 1600 with a preferred range of 1000 to 1400. Membranes having a water absorption of about 25% or greater are preferred since higher cell potentials at any given current density are required for membranes having less water absorption. Similarly, membranes having a film thickness (unlaminated) of about 8 mils or more, require higher cell potentials in the process of the present invention and thus have a lower power efficiency.

Typically, because of large surface areas of the membranes present in commercial cells, the membrane film will be laminated to and impregnated into a hydraulically permeable, electrically non-conductive, inert, reinforcing member, such as a woven or non-woven fabric made of fibers of asbestos, glass, TEFLON, or the like. In film/fabric composite membranes, it is preferred that the laminating produce an unbroken surface of the film resin on at least one side of the fabric to prevent leakage through the membrane.

The hydraulically impermeable cation-exchange membranes of the type in question are further described in the following patents which are hereby incorporated by reference: U.S. Pat. Nos. 3,041,317; 3,282,875; 3,624,053; British Pat. No. 1,184,321 and Dutch Published Application 72/12249. Membranes as aforedescribed are available from E. I. duPont de Nemours and Co. under the trademark NAFION.

The membranes as above described can be further modified with surface treatments to obtain an improved membrane. Generally, these treatments consist of reacting the sulfonyl fluoride pendant groups with substances which will yield less polar bonding and thereby absorb fewer water molecules by hydrogen bonding. This has a tendency to narrow the pore openings through which the cations travel so that less water of hydration is transmitted with the cations through the membrane. An example of this would be to react an ethylene diamine with the pendant groups to tie two of the pendant groups together by two nitrogen atoms in the ethylene diamine. Generally, in a film thickness of about 7 mils, the surface treatment will be done to a depth of about 2 mils on one side of the film by means of a timed reaction procedure. This will result in a membrane with good electrical conductivity and cation transmission with less hydroxide ion and associated water reverse migration.

It is anticipated that those skilled in the art will be able to assemble the given components into the monopolar membrane electrolytic cell 12 by use of various fastening means to secure the components in sealing engagement about the peripheral flanges 34 and 20. In each case however it will be necessary to use some type of sealing material such as gasketing 22 on either side of membrane 44 sandwiched between the peripheral flanges 20 and 34. Gasketing 22 serves the dual purpose of affecting a sealing engagement between the electrode assemblies of opposite polarity and also as a spacing means to provide the gap necessary between the electrode elements and the membrane 44 and each other. Any gasketing material must of course be resistant to the electrolyte used within the cell 12 thus polymeric compositions such as neoprene are examples of suitable materials. Experience indicates that the gap between the electrode elements should be in the range of 0.120 inch (3.048 millimeters), plus or minus 0.060 inch (1.524 millimeters) tolerance. It is felt that an effective sealing engagement between peripheral flanges 34 and 20 may be achieved by use of fasteners including break mandrel rivets, flange clips, flange clamps utilizing swivel socket set screws or bolts through the flanges.

Figure 8:
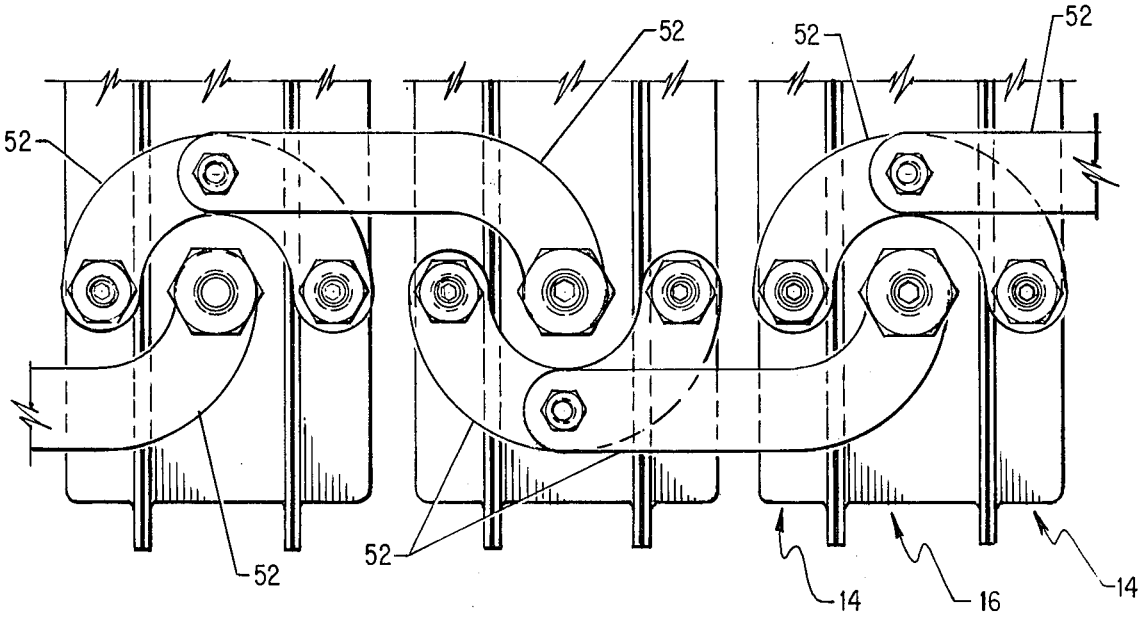
FIG. 8 is a partial top elevation view of the bank of electrolytic cells showing the electrical bus-bar connections between the respective monopolar membrane electrolytic cells connected in a series circuit.
Figure 9:
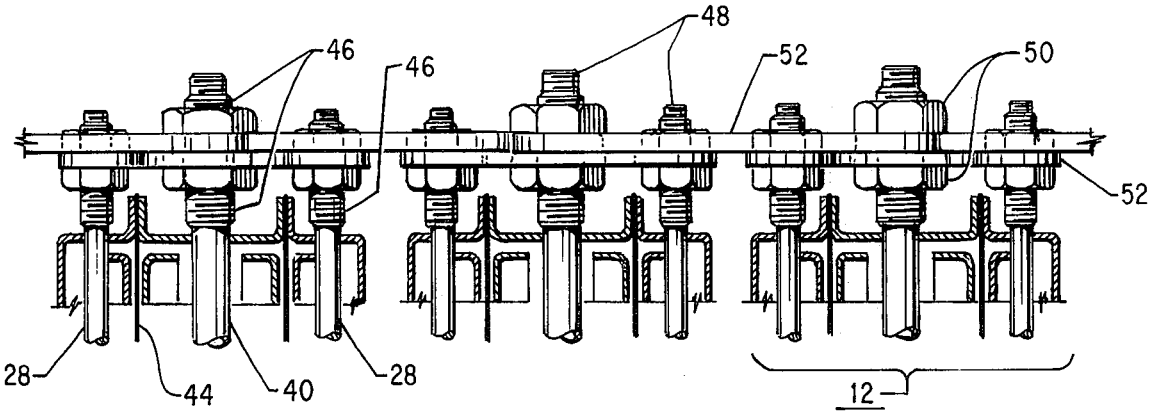
FIG. 9 is a sectional view of the electrolytic cell bank showing the bus-bar connections between the respective monopolar membrane electrolytic cell units taken substantially along line 9—9 of FIG. 8.

As can be seen in FIGS. 2 and 5 and especially in FIGS. 4 and 7 the current distributors 28 and 40 go through the end electrode pan 18 and central electrode frame 32 respectively for connection thereof to an electrical power source. FIG. 8 is a top elevation view showing one system of bus bars by which several electrolytic cells 12 may be combined in series to perform as a bank of electrolytic cells 12. FIG. 9 shows a section view taken substantially along line 9—9 of FIG. 8 showing the electrical connection arrangement for the electrolytic cells 12. Electrical connection of cells 12 in series or parallel may be accomplished by the use of a threaded spool 46 connected to the current distributors 28 and 40 by means of a threaded bolt 48 journaled therethrough and bolted against the current distributors 28 and 40. The threaded spool 46 should be made of a highly electrically conducting substance such as copper. First a jam nut 50 is run own the threaded spools 46 to provide a stop for the bus bars 52 which are placed thereover and interconnected between the several electrolytic cells 12 as shown in FIGS. 8 and 9. Then a second jam nut 50 is threaded down into tight engagement with the electrical bus bars 52 to provide positive locking engagement between the bus bars 52 and the threaded spools 46. In this fashion electrical connection is had between each central electrode current distributor 40 of one electrolytic cell 12 and both end electrode current distributors 28 of the next cell 12 in the series as seen in FIGS. 8 and 9. Electrical current may be supplied from both ends of the series of electrolytic cells 12 or one end as desired. The cells 12 pictured in FIG. 1 may just as easily be connected in parallel by use of common feeders to connect all assemblies of one polarity to one terminal and all assemblies of opposite polarity to the other terminal of the power source.

To remove any cell 12 from a bank of cells, the threaded bolts 48 are removed for all electrode assemblies of that cell 12 so that the cell 12 may be facilely withdrawn from the bank. A jumper cable or bus bar must first be connected across the positive and negative terminals of the cell 12 to be removed in order to maintain a complete circuit by which the remaining cells 12 are operated, when the cells 12 are connected in a series circuit as seen in FIGS. 8 and 9. If the cells 12 are connected in a parallel circuit, the jumper will not be necessary since each cell 12 operates on its own circuit.

Figure 10:
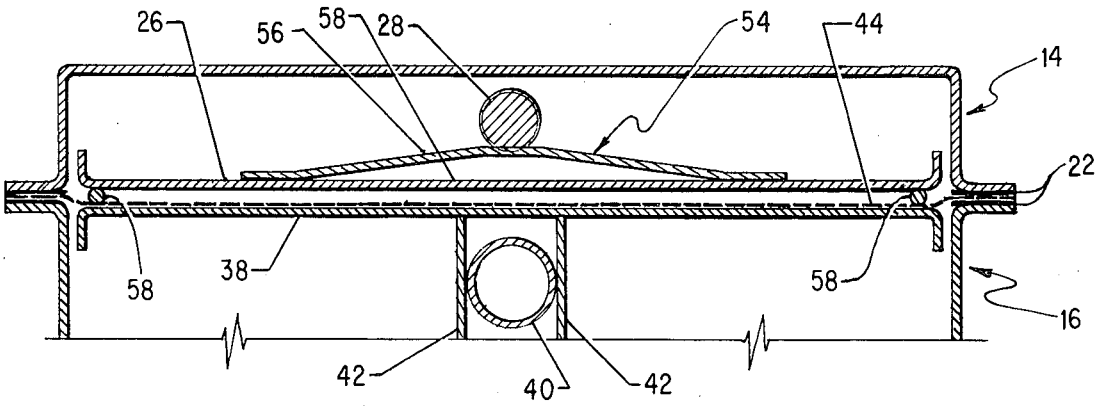
FIG. 10 is a sectional view showing an alternative from of the end electrode assembly having the expandable cathode.

FIG. 10 depicts an alternate embodiment of the end electrode assembly 14 having an expandable electrode 54 such that upon assembly of the given electrolytic cell 12 the membrane 44 will be held in place up against the central electrode element 38. The major difference in the expandable electrode 54 is the supporting structure between the current distributor 28 and the electrode element 26. Instead of using spacer bars 30 the expandable cathode 54 utilizes an expander 56 such as a single piece flat spring which is attached to the current distributor 28 at a single point along the length thereof and extends to connection with the electrode element 26 at two distant points near the outer most edge of the electrode element 26. The expander 56 also has apertures therethrough to allow for good circulation throughout the end electrode assembly 14. On the other side of the electrode element 26 and directly opposite from the points where the expander 56 is connected to the electrode element 26 are spacer rods 58 which press the membrane 44 against the electrode element 38 when the cell components are assembled into the electrolytic cell 12. These spacer rods 58 should generally be made of an electrically non-conductive substance such that very little interference is caused thereby to the overall evenness of the gap between the electrode elements. Polyvinyl fluoride would be an example of a suitable material. It is contemplated that the expandable electrode 54 may be used just as well in the central electrode assembly 16.

As can be further seen in FIG. 11, those skilled in the art can build a filter press type monopolar membrane electrolytic cell 60 by inserting several central electrode assemblies 16 between the two end electrode assemblies 14. Several central electrode assemblies 16 must be fabricated of appropriate materials as hereinabove described to provide both anodic and cathodic sections for the cell structure. Each cell 60 will run with the sections connected in a series circuit. Several cells 60 could be connected in either a series or parallel circuit to build a cell bank. As seen in FIG. 11, the central electrode peripheral flanges 34 may be extended to provide a resting surface for a free standing cell structure.

It is desirable to use the end electrode assemblies 14 as the cathode side since the materials involved are generally less expensive. Monopolar membrane electrolytic cell 12 would have an anode section 16 sandwiched between two cathode sections 14 and the filter press type monopolar electrolytic cell 60 of FIG. 11 has six anode central electrode assemblies 16, five cathode central electrode assemblies 16 and two cathode and electrode assemblies 14. The cell 60 would be assembled such that each assembly 16 would have neighbors of opposite polarity.

It has been found that with the gasketing 22 between the assemblies 14 and 16, that the hydrogen embrittlement phenomenon does not occur. This cell structure also yields a light weight unit which makes maximum usage of cell room space.

Testing has indicated that a minimum distance of 2.25 inches (57.15 millimeters) between the space of the mesh end electrode element 24 and the inside wall of the end electrode pan 16 is necessary for optimum operation of the electrolytic cell 11 at a current density of two amperes per square inch (310 milliamperes per square centimeter) when the end electrode assembly 14 functions as the cathode. This space requirement for the central electrode 16 for similar operation would be in the range of 3.5 to 4 inches (88.8 to 101.6 millimeters) when the central electrode assembly 16 functions as the anode. It is felt that electrolytic cells according to the preferred embodiments herein described could obtain a peak current of three amperes per square inch (465 milliamperes per square centimeter) in a commercial operation.

During a typical operation of a monopolar membrane electrolytic cell 12 according to the concepts of the present invention for chlorine and caustic production, a brine having a sodium chloride concentration of approximately 100 to 310 grams per liter was introduced into the central electrode assembly 16 being used as the anodic side of the electrolytic cell 11 while water or recirculating sodium hydroxide solution of approximately 24 to 43 percent was introduced into the end electrode assembly 14 being used as the cathodic side of the cell 12. As the electrolyzing direct current was impressed upon the cell from a suitable power source, chlorine gas is evolved at the anode element 38. The evolved chlorine is completely retained within the anode compartment 16 until it is removed from the cell along with the brine solution through the anode access ports 36. Sodium ions formed in the anode assembly 16 selectively migrate through the membrane 44 into the cathode assembly 14 where they combine with hydroxide ions. Sodium hydroxide and hydrogen gas thus formed are removed through the cathode access ports 24. Noncritical process parameters include: operating temperature in the range of 25° to 100° C; a brine feed pH in the range of one to six; and a current density through the electrolytic cell 12 in the range of one to five amperes per square inch (155 to 775 milliamperes per square centimeter) of electrode plate surface area.

Thus it should be apparent from the foregoing description of the preferred embodiments that the monopolar membrane electrolytic cells 12 and 60 herein shown and described accomplish the objects of the invention and solve the problems attendant to such devises.

What is claimed is:

1. A monopolar membrane electrolytic cell comprising: two end electrode pans of identical configuration having a peripheral flange therearound; end electrode elements connected to the interior depression of each of said end electrode pans; a central electrode frame having peripheral flanges on each side thereof to match the corresponding flanges of said end electrode pans for sealing engagement when connected to form the monopolar membrane electrolytic cell; a bifurcated central electrode element such that each presents a substantially planar surface to said corresponding end electrode element connected to the interior of said central electrode frame; a membrane separating said end electrode elements from said central electrode element when the cell is assembled; current distributors to supply electrical energy of opposite polarity to said central electrode elements and said end electrode elements; and at least one access port in each compartment for adding materials or removing products.

2. In electrolytic cells according to claim 1 wherein said end electrode elements and said bifurcated central electrode element are mechanically and electrically connected to said current distributors by spacer bars perpendicularly connected to said end electrode elements and said bifurcated central electrode element and connected on opposite sides of said current distributors.

3. An electrolytic cell according to claim 2 wherein said spacer bars extend only a portion of the internal length of said current distributors.

4. An electrolytic cell according to claim 3 wherein said spacer bars have apertures therethrough to enhance electrolyte solution flow within the electrolytic cell.

5. An electrolytic cell according to claim 1 wherein said end electrode elements are in two sections in each of said end electrode pans.

6. An electrolytic cell according to claim 1 wherein each part of said bifurcated central electrode element is divided into two sections.

7. An electrolytic cell according to claim 1 wherein the peripheral flanges of said end electrode pans and said central electrode frame are assembled with said membrane therebetween and gasketing on either side of said membrane.

8. An electrolytic cell according to claim 7 wherein fastening means are used to sealingly engage the peripheral flanges of said end electrode pans to said central electrode frame.

9. An electrolytic cell according to claim 1 wherein said current distributors pass through said end electrode pans and said central electrode frame to the exterior portion of the electrolytic cell.

10. An electrolytic cell according to claim 9 wherein threaded spools are secured to each of said current distributors projecting exterior of the electrolytic cell.

11. An electrolytic cell according to claim 10 wherein said threaded spools are secured to said current distributors by threaded bolts such that upon withdrawal of said threaded bolts, the electrolytic cell may be facilely removed from a bank of cells.

12. An electrolytic cell according to claim 10 wherein a jam nut is threaded down said threaded spool to provide a stop.

13. An electrolytic cell according to claim 12 wherein bus bars are inserted over each of said threaded studs such that both of said end electode pans of each electrolytic cell are interconnected to said threaded spools protruding from said central electrode frame of the next succeeding electrolytic cell in a series of electrolytic cells.

14. An electrolytic cell according to claim 13 wherein a second jam nut is threaded into tight engagements with said bus bars.

15. An electrolytic cell according to claim 1 wherein said end electrode elements are connected to said current distributors by means of an expander attached on opposite sides of said current distributors and said end electrode elements.

16. An electrolytic cell according to claim 15 wherein said end electrode elements have spacer rods connected to the face opposite that connected to said current distributors, of an electrically nonconductive nature to maintain said membrane in constant contact with said electrode elements of the adjacent electrode assembly.

17. An electrolytic cell according to claim 1 wherein said central electrode elements are connected to said current distributors by means of an expander attached on opposite sides of said current distributors and said central electrode element.

18. An electrolytic cell according to claim 17 wherein said central electrode elements have spacer rods connected to the face opposite that connected to said current distributors, of an electrically nonconductive nature to maintain said membrane in constant contact with said electrode elements of the adjacent electrode assembly.

19. An electrolytic cell according to claim 1 wherein said membrane is a hydraulically impermeable cation-exchange membrane consisting essentially of a film of copolymer having the repeating structural units of the formula:

$$-CF_2-\underset{\substack{|\\(R)_n\\|\\SO_3H}}{CF}- \qquad (1)$$

and $$-CF_2-Cxx^1- \qquad (2)$$

wherein R represents the group $$-\overset{\substack{R^1\\|}}{CF}-CF_2-O-(CFY-CF_2O)_m,$$

in which $R^1$ is fluorine or perfluoroalkyl of 1 to 10 carbon atoms; Y is fluorine or trifluoromethyl; *m* is 1, 2 or 3; *n* is 0 or 1; *x* is fluorine, chlorine, or trifluoromethyl; $x^1$ is *x* or $CF_3$ — of the formula 1 being present in an amount to provide a copolymer having a $-SO_3H$ equivalent weight in the range of 1,000 to 1,400.

20. An electrolytic cell according to claim 19 wherein said membrane has been surface treated to improve the selective migration of ions thereacross.

21. A filter press type monopolar membrane electrolytic cell comprising: two end electrode pans of identical configuration having a peripheral flange therearound; end electrode elements connected to the interior depression of each of said pans; more than one central electrode frame having peripheral flanges on each side thereof; a bifurcated central electrode element in each of said frames so as to present an active surface to each side of said frames; a membrane separating said electrode elements; current distributors to supply electrical energy of opposite polarity to adjacent electrode elements; and at least one access port in each compartment such that upon assembly of the electrolytic cell each and every of said central electrode frame is sandwiched between electrodes of opposite polarity.

22. An end electrode assembly for an electrolyte cell comprising: a pan having a central depression and a peripheral flange; an electrode element connected to the central depression of said pan; at least two current distributors to supply electrical energy to said electrode element, electrically and mechanically attached to said electrode element and extending exterior of said pan; and at least one access port in said pan for adding or removing materials from the interior of said pan.

23. An end electrode assembly according in claim 22 further comprising spacer bars connected on either side of said current distributors and connected perpendicularly to said electrode element.

24. An end electrode assembly according to claim 23 wherein said spacer bars extend less than the full length of said electrode element.

25. An end electrode assembly according to claim 23 wherein said spacer bars have apertures therethrough to aid circulation with the end electrode assembly.

26. A central electrode assembly for an electrolytic cell comprising: a frame having peripheral flanges on each side thereof; a bifurcated electrode element secured to the interior confines of said frame presenting a substantially planar surface to each side of said frame and nearly coplanar with the peripheral flanges; at least two current distributors between said bifurcated electrode element surfaces to supply electrical energy to said bifurcated electrode element, electrically and mechanically connected to said bifurcated electrode element and extending exterior of said frame; and at least one access port in said frame for adding or removing materials from the interior of said frame.

27. A central electrode assembly according to claim 26 further comprising spacer bars connected to said current distributors on either side thereof and connected perpendicularly to each surface of said bifurcated electrode element.

28. A central electrode assembly according to claim 27 wherein said spacer bars extend less than the full length of said bifurcated electrode element.

29. A central electrode assembly according to claim 27 wherein said spacer bars have apertures therethrough to aid circulation within the central electrode assembly.

* * * * *